US005267447A

United States Patent [19]

Yamamoto

[11] Patent Number: 5,267,447

[45] Date of Patent: Dec. 7, 1993

[54] PROCESS AND DEVICE FOR PREVENTING THE LIQUEFACTION-LEAKAGE PHENOMENON OF GAS IN A PRESSURE REGULATOR

[75] Inventor: Ryoichi Yamamoto, Landshut, Fed. Rep. of Germany

[73] Assignee: Teisan Kabushiki Kaisha, Tokyo, Japan

[21] Appl. No.: 859,867

[22] Filed: Mar. 30, 1992

[30] Foreign Application Priority Data

Apr. 2, 1991 [JP] Japan ..... 3-094944

[51] Int. Cl.[5] ..... F17C 13/00

[52] U.S. Cl. ..... 62/50.7; 73/40.7

[58] Field of Search ..... 62/50.7; 73/40.7; 137/312

[56] References Cited

U.S. PATENT DOCUMENTS 3,364,729 1/1968 Yearwood ..... 73/40.7
3,489,311 1/1970 Folkerts et al. ..... 73/40.7
3,913,341 10/1975 Katsuda ..... 73/40.7
4,450,711 5/1984 Claude ..... 73/40.7
4,834,137 5/1989 Kawaguchi et al. .

FOREIGN PATENT DOCUMENTS 241457 10/1925 United Kingdom .

*Primary Examiner*—Ronald C. Capossela
*Attorney, Agent, or Firm*—Oblon, Spivak, McClelland, Maier & Neustadt

[57] ABSTRACT

The invention relates to a process and device to prevent the liquefaction-leakage phenomenon of a gas in a pressure regulator, in which a gas pipe between a high pressure gas supply source and a pressure regulator for reducing the pressure of gas comprises a double pipe consisting of an inner pipe and an outer pipe, wherein a high pressure feed gas is caused to flow through the inner pipe and a heated inert gas through the outer pipe, thereby heating the high pressure feed gas. After sweeping the inner pipe, the inert gas is analysed to detect the presence of even small traces of the high pressure gas which indicate a leak in the inner pipe.

13 Claims, 2 Drawing Sheets

PROCESS AND DEVICE FOR PREVENTING THE LIQUEFACTION-LEAKAGE PHENOMENON OF GAS IN A PRESSURE REGULATOR

BACKGROUND OF THE INVENTION

1. Field of the Invention

The present invention relates to a device for preventing the liquefaction-leakage phenomenon of gas in a pressure regulator.

2. Description of the related art

For doping gases in the manufacture of semiconductors, for instance, it is known to use diborane gas ($B_2H_6$) or a gas mixture of diborane gas and argon, nitrogen and/or silane gas. As shown on FIG. 1, such gas is usually stored under high pressure in a cylinder 1, for example pure diborane gas at about 30 bar and a mixed gas of diborane gas and argon at a higher pressure of 100 bar. At a feed installation, the pressure of said doping gas is reduced to several bars by the use of a pressure regulator 2.

When the pressure of a high pressure gas, such as a doping gas, is reduced by a using a pressure regulator, said gas is cooled and might be at least partially liquefied because of its free expansion through the pressure regulator. This can generate some leaks out of the valve seal of the pressure regulator. This situation is known as a liquefaction-leakage phenomenon of gas which makes the working of a pressure regulator unsafe, As diborane gas or the like is a very poisonous gas, this kind of leakage can generate important environmental problems.

It has already been proposed in Japanese Patent Application Kokai No. 238,800/1989, a solution to this leakage problem as represented on FIG. 2: a gas pipe 3 connecting a gas cylinder 1 containing said doping gas and a pressure regulator 2 is heated by a heating device 4 provided around said gas pipe 3. This heating device 4 is controlled by an automatic controller 5 which controls the heat transferred to the gas pipe 3 so that the feed gas is heated in the heating device 4. This feed gas is heated at a temperature which is such that the temperature of the gas at outlet 7 after expansion through the pressure regulator 2 is at least equal to or greater than the temperature of the feed gas in the pipe 3 before heating by said device 4. As a result, the temperature of the feed gas from the gas cylinder 1 is made almost equal to that of the gas at the gas outlet 7 of the pressure regulator 2, thereby preventing the liquefaction-leakage of the feed gas.

In such a conventional device, however, it is difficult to carry out the temperature control of the gas pipe 3, i.e. the temperature of the feed gas by the heating device 4. It is furthermore difficult to detect whether the feed gas leaks from the gas pipe 3 through pin holes formed by corrosion.

The present invention is intended to eliminate the aforementioned drawbacks.

SUMMARY OF THE INVENTION

The present invention provides a process and a device for preventing the liquefaction-leakage phenomenon of a gas in a pressure regulator wherein the gas pipe between the high pressure gas supply source and the pressure regulator for reducing the pressure of said gas comprises a double pipe consisting of an inner pipe and an outer pipe, wherein the high pressure gas from the high pressure gas supply source is caused to flow through the inner pipe and a heated inert gas is caused to flow through the outer pipe, or vice-versa, whereby the temperature drop of the high pressure gas through the pressure regulator due to its free expansion in the pressure regulator is at least partly compensated to prevent the liquefaction-leakage of the same high pressure gas, while detection means are provided to analyze the gas mixture extracted from the outer pipe to further detect whether the high pressure gas is mixed with the inert gas thereby detecting the leakage of the same high pressure gas from the inner pipe.

DETAILED DESCRIPTION OF THE INVENTION

Figure 1:
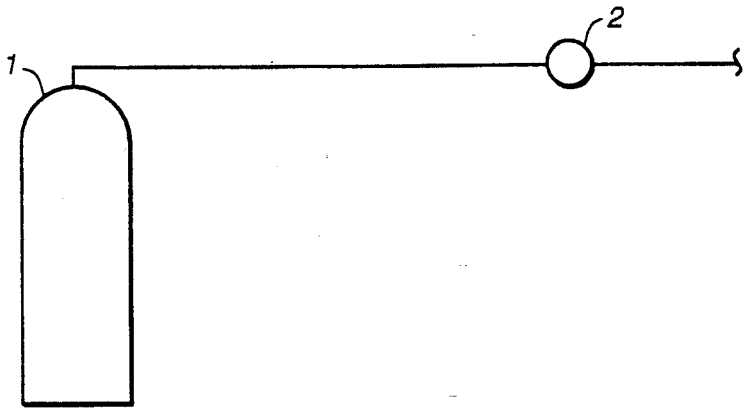
FIG. 1 (PRIOR ART)
FIG. 1 illustrates the prior art, wherein high pressure has is stored in a cylinder, which is attached to a feed line having a pressure regulator.
Figure 2:
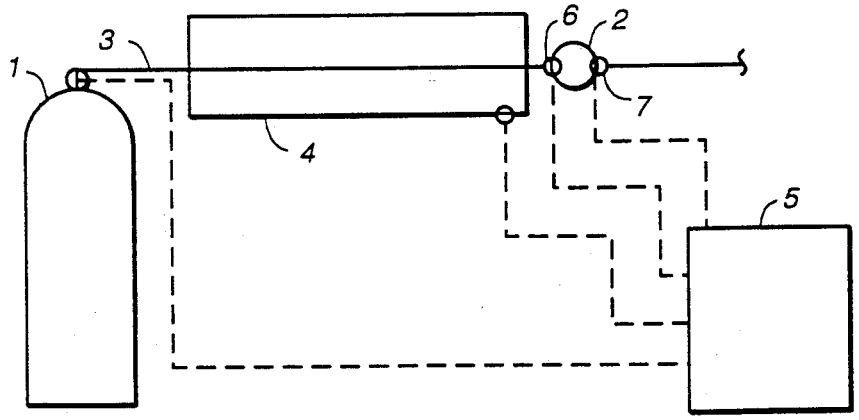
FIG. 2 (PRIOR ART)
FIG. 2 illustrates the prior art, wherein a has pipe connecting a gas cylinder and a pressure regulator is heated by a heating device around the gas pipe.
Figure 3:
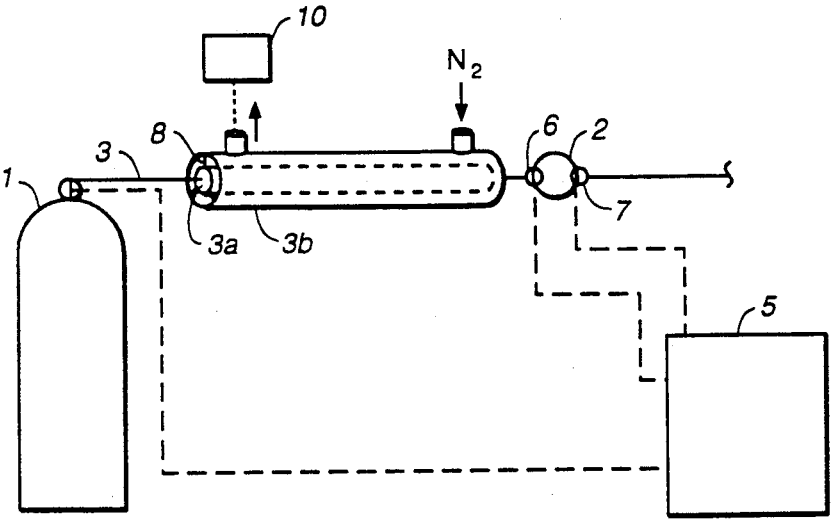
FIG. 3 illustrates the present invention, wherein a heated gas pipe connecting a gas cylinder and a pressure regulator is a double pipe having an inner and an outer pipe, and high pressure gas flows through the inner pipe.

An embodiment of the present invention is represented schematically on FIG. 3.

According to the present invention, as shown on FIG. 3, the double pipe 3 consists of an inner pipe 3*a* and an outer pipe 3*b*. A high pressure feed gas such as a doping gas from a gas cylinder 1 is caused to flow through the inner pipe 3*a* and a heated inert gas such as nitrogen gas flows from one end of the outer pipe 3*b* toward the other end thereof, or vice-versa, whereby the inner pipe 3*a*, i.e. the doping gas flowing therein is heated at a given temperature. Further, the nitrogen gas extracted from the other end of the outer pipe 3*b* is passed through a detector 10 to detect the presence of doping gas mixed with the nitrogen gas.

While it might be preferable to have the inert gas (nitrogen, argon, helium, xenon, etc . . .) flowing countercurrent to the flow of the high pressure doping gas, co-current flowing is also possible. The temperature of the inert gas is controlled (and the flowrate too) to maintain the inner pipe and the high pressure gas at a temperature sufficient to avoid any liquefaction of said gas by expansion through said pressure regulator. This temperature depends on the liquefaction temperature of said high pressure gas at the considered pressure. The man skilled in the art will determine according to its safety goals to avoid leaks, how much he needs to heat the high pressure gas in order to minimize or avoid the risk of liquefaction of said high pressure gas by expansion through the pressure regulator.

In addition, the reference numeral 8 represents spacers inserted between the inner pipe 3*a* and the outer pipe 3*b*. The material for the spacer will be selected among those which have heat insulating and/or rigidity properties and which can withstand the required temperature of the inert gas. It is also possible in circumstances where leaks in the inner pipe do not exist or are otherwise prevented to use the shrouding gas only for the purpose of heating the high pressure gas. In this case, said gas will not be necessarily inert.

The device for preventing the liquefaction-leakage phenomenon of gas in a pressure regulator according to the present invention is much advantageous, because of the aforementioned constitution. Namely, the temperature of the doping gas flowing through the inner pipe 3*a* can be controlled with accuracy by controlling the temperature of the heated nitrogen gas flowing through the outer pipe 3*b*, whose temperature is very easily regulated at an optional value by-a conventional known means, whereby the liquefaction-leakage phenomenon of the same doping gas due to its free expansion in the pressure regulator can be avoided. Furthermore the leakage of the doping gas from the inner pipe 3*a* can be easily detected by detecting whether the doping gas is mixed in the inert gas. Thus, the aforementioned danger in the prior art can be easily prevented.

According to another embodiment of the invention, the high pressure (doping) gas can flow in the outer pipe while the inert gas flows through the inner pipe.

Figure 4:
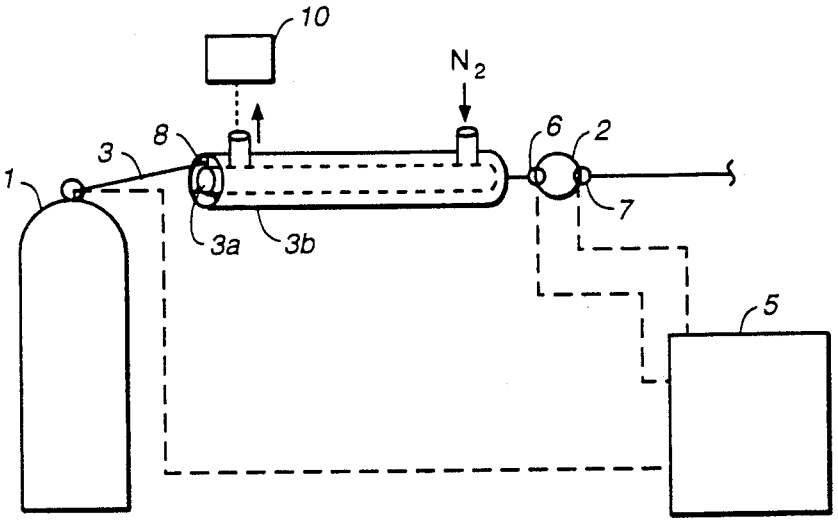
FIG. 4 illustrates the present invention, wherein a heated gas pipe connected a gas cylinder and a pressure regulator is a double pipe having an inner and an outer pipe, and high pressure gas flows through the outer pipe.

FIG. 4 illustrates this embodiment, wherein a heated gas pipe (3) connecting gas cylinder (1) with pressure regulator (2) is a double pipe having an inner and an outer pipe, and the high pressure gas flows through outer pipe (*eb*) while heated inert gas flows through inner pipe (3*a*). Thus, the detector is arranged to detect leakage from inner pipe (3*b*) to outer pipe (3*a*).

The same liquefaction-leakage phenomenon can appear through any expansion device and the invention not only applies to pressure regulator but to any expansion device where leaks might occur.

While the above embodiments of the invention have been described with particularity, it will be understood that various other modifications will be apparent to and can be readily made by those skilled in the art without departing from the scope and spirit of the invention, including but not limited to the equivalent means of the invention for the man skilled in the art.

I claim:

1. A device for preventing liquefaction-leakage of a gas, which comprises:

a) a source of high pressure gas in fluid connection with a gas pipe downstream thereof, b) a gas pipe comprising an inner pipe and an outer pipe, whereby the high pressure gas from the source is able to flow through either the inner pipe or the outer pipe and a heated gas is able to flow through the outer pipe or the inner pipe, respectively, said gas pipe having said inner and outer pipes being contained within heating means, which heats said gas in said inner pipe or outer pipe, c) expansion means having an inlet and outlet in fluid connection with, and downstream of, said gas pipe, d) heat controlling means connected to said heating means containing said gas pipe, and e) detecting means in fluid connection with said inner pipe or outer pipe of said gas pipe, for detecting gas leakage of said high pressure gas from said inner pipe to said outer pipe, or from said outer pipe to said inner pipe.

2. The device according to claim 1, further comprising means for controlling the temperature of the heated gas.

3. The device according to claim 1, wherein said heated gas is an inert gas.

4. The device according to claim 1, wherein the heated inert gas is selected from the group consisting of nitrogen, argon, helium and xenon.

5. The device according to claim 4, wherein said heated inert gas is nitrogen.

6. The device according to claim 1, wherein said expansion means is a pressure regulator.

7. A process for preventing liquefaction-leakage of a gas from an expansion means, wherein a high pressure gas flows through a pipe from a source to said expansion means to reduce the pressure of said gas to a lower pressure, which process comprises:

a) passing high pressure gas from a source to a gas pipe comprising an inner pipe and an outer pipe, whereby the high pressure gas from the source flows through the inner pipe or outer pipe and a heated gas flows through the outer pipe or inner pipe, respectively, the gas pipe being contained within heating means, which heats the gas in the outer pipe or inner pipe, and b) passing the high pressure gas through the expansion means, in fluid connection with, and downstream of, the gas pipe, whereby a temperature decrease of the high pressure gas through the expansion means is at least partly compensated to prevent liquefaction-leakage of said gas from said expansion means.

8. The process according to claim 5, wherein said heated gas is an inert gas.

9. The process according to claim 6, wherein said inert gas is selected from the group consisting of nitrogen, argon, helium and xenon.

10. The process according to claim 5, wherein said heated gas and said high pressure gas flow countercurrent to each other.

11. The process according to claim 5, wherein heated gas and said high pressure gas flow co-currently to each other.

12. The process according to claim 5, further comprising detecting the presence of said high pressure gas in said heated gas.

13. The process according to claim 5, wherein said expansion means is a pressure regulator.

* * * * *